US011519116B2

(12) United States Patent
Albrecht et al.

(10) Patent No.: US 11,519,116 B2
(45) Date of Patent: Dec. 6, 2022

(54) PUCKERING STRETCHABLE FABRIC

(71) Applicant: Albrea Enterprises Inc., Cedar City, UT (US)

(72) Inventors: Rachelle H. Albrecht, Cedar City, UT (US); S. Laurie Hansen, Cedar City, UT (US)

(73) Assignee: Albrea Enterprises Inc., Cedar City, UT (US)

( * ) Notice: Subject to any disclaimer, the term of this patent is extended or adjusted under 35 U.S.C. 154(b) by 1169 days.

(21) Appl. No.: 16/045,687

(22) Filed: Jul. 25, 2018

(65) Prior Publication Data

US 2020/0032441 A1 Jan. 30, 2020

(51) Int. Cl.
*D06C 3/00* (2006.01)
*A47G 9/08* (2006.01)
(Continued)

(52) U.S. Cl.
CPC ..... *D06C 3/00* (2013.01); *A47G 9/08* (2013.01); *D03D 15/56* (2021.01); *D05B 1/08* (2013.01);
(Continued)

(58) Field of Classification Search
CPC . D06C 3/00; D03D 15/56; A47G 9/08; A47G 9/083; A47G 9/086; D05B 13/00; D05B 1/08
See application file for complete search history.

(56) References Cited

U.S. PATENT DOCUMENTS 2,134,630 A * 10/1938 French ..... D06J 1/12 139/421
2,564,959 A 8/1951 Gaetano
(Continued)

FOREIGN PATENT DOCUMENTS

FR 2759562 A1 * 8/1998 ..... A47G 9/086
GB 479194 A 2/1938

OTHER PUBLICATIONS

"Albrea—All Products" (Albrea) [online] retrieved from URL: https://www.albrea.com/all-products.html, Jan. 19, 2018, 1 Page.
(Continued)

*Primary Examiner* — Nathan E Durham
(74) *Attorney, Agent, or Firm* — Goff IP Law PLLC; Jared S. Goff

(57) ABSTRACT

Elastic thread lines can extend along borders of puckering areas of a fabric. The thread lines can include elastic thread line sections of the thread lines passing through thread line intersections and segments of the thread lines between the intersections. The elastic thread lines can bias the puckering areas in multiple different non-parallel directions toward a puckered configuration. In the puckered configuration, the puckering areas can be gathered together to pucker the fabric. The fabric can be stitched together to form a product, such as a sleeping bag sack that is stretchable in multiple orthogonal directions by stretching the thread lines. Elastic thread line sections passing through intersections can be made more secure by forming thread line section patterns that increase numbers of thread line crossings at the intersections. Densities of thread lines in different directions can be selected to produce different amounts of gathering, and for security.

27 Claims, 10 Drawing Sheets

(51) Int. Cl.

| | |
|---|---|
| ***D03D 15/56*** | (2021.01) |
| ***D05B 1/08*** | (2006.01) |
| ***D05B 13/00*** | (2006.01) |

(52) U.S. Cl.
CPC ..... *D05B 13/00* (2013.01); *D10B 2401/061* (2013.01); *D10B 2503/06* (2013.01)

(56) References Cited

U.S. PATENT DOCUMENTS

| | | | | |
|---|---|---|---|---|
| 2,687,703 | A | 8/1954 | Nathan | |
| 2,866,459 | A * | 12/1958 | Sobelson ..... | A61F 13/49007 604/377 |
| 4,884,303 | A | 12/1989 | Scherer | |
| 5,244,716 | A | 9/1993 | Thornton et al. | |
| 5,473,779 | A | 12/1995 | Kramer | |
| 6,931,680 | B2 | 8/2005 | Bellick et al. | |

OTHER PUBLICATIONS

"International Search Report and the Written Opinion of the International Searching Authority", International Application No. PCT/US 19/40874, Sep. 30, 2019, 7 Pages.
Whittle, Katie, "A Guide to Shirring", Seamwork Magazine, Jun. 2017, Retrieved from «https://www.seamwork.com/issues/2017/06/a-guide-to-elastic-shirring», 21 Pages.
Albrecht, Rachelle H., et al., "Statement by Inventors Regarding Prior Activities", Jul. 25, 2018, 3 Pages.

* cited by examiner

100

PUCKERING STRETCHABLE FABRIC

BACKGROUND

Fabrics are made of natural and/or synthetic fibers that are joined together, such as through weaving or knitting. Some fabrics are more stretchable than others. For example, fabrics made with fibers that have a large amount of elastic stretch, such as spandex, can exhibit greater elastic stretch than fabrics made with other types of fabrics. Whether fabrics are made with such highly stretchable fibers or not, fabrics themselves can allow for some stretching characteristics. Also, fabrics may exhibit greater stretch in some directions than in other directions. For example, a fabric may exhibit greater stretch in its crosswise grain direction than in its lengthwise grain direction. Also, a fabric may exhibit greater stretch in its bias direction, which is at a forty-five-degree angle to the lengthwise and crosswise grain directions, than in the lengthwise or crosswise grain directions.

Some fabrics have been sewn with elastic threads to gather the adjacent fabric in the direction of the thread lines of the elastic threads. This is sometimes referred to as shirring. For example, shirring may be done by loading a sewing machine bobbin with elastic thread, loading the machine with a non-elastic top thread, and sewing a thread line along fabric. Shirring is often done with multiple thread lines of elastic threads running close together (typically less than an inch apart) to gather an area of fabric, such as in some localized areas for some types of clothing.

SUMMARY

It has been found that elastic thread can be used to produce puckering stretchable fabric. It has also been found that specific types of patterns of elastic thread lines defining puckering areas in the fabric can produce one or more desirable benefits. For example, such patterns may include having multiple thread lines running along substantially the same path and/or varying configurations of the thread lines at thread line intersections to increase numbers of thread lines that are crossed by individual thread line sections passing through a thread line intersection. Moreover, it has been found that the puckering stretchable fabric can be used to form a sleeping bag sack that has benefits, such as advantageous comfort and/or insulating characteristics.

According to one aspect, a technique includes sewing one or more elastic thread lines into a fabric while maintaining areas of the fabric being sewn in a smooth configuration. The thread line(s) can extend along borders of puckering areas of the fabric. The elastic thread line(s) can form a pattern that includes elastic thread line sections of the one or more elastic thread lines passing through intersections with each other and segments of the elastic thread lines extending between the intersections. At one or more of the intersections, one or more of the elastic thread line sections passing through the intersection can loop around a central point of the intersection to form at least a partial loop around the central point of the intersection. The pattern can produce a greater number of thread line section crossings at the intersection than would have been present if the one or more looping sections had not looped around the central point. The elastic thread lines can bias the puckering areas in multiple different non-parallel directions toward a puckered configuration. In the puckered configuration, the puckering areas can be gathered together to pucker the fabric in the puckering areas.

According to another aspect, a stretchable fabric system can include a series of puckering areas of a fabric that are spaced from each other in multiple directions. The system can also include elastic thread lines sewn into the fabric and extending along borders of the puckering areas. The elastic thread lines can bias the puckering areas toward a puckered configuration wherein the puckering areas are gathered together to pucker the fabric in the puckering areas. The elastic lines can be stretchable to stretch the puckering areas in multiple orthogonal directions toward a smooth configuration wherein the fabric in the puckering areas is smoothed in comparison to the puckered configuration. The elastic thread lines can form a pattern that includes sections of the elastic thread lines passing through intersections with each other. At one or more of the intersections, an elastic thread line section passing through the intersection can cross one or more thread line sections to form thread line section crossings in an area of the intersection. A number of the thread line section crossings for the elastic thread line passing through the intersection can be at least two.

According to yet another aspect, a stretchable sleeping bag sack can include a series of puckering areas of fabric that are spaced from each other in multiple directions. Elastic thread lines can be sewn into the fabric and can extend along borders of the puckering areas. The elastic thread lines can bias the puckering areas toward a puckered configuration wherein the puckering areas are gathered together to form a puckering of the fabric in the puckering areas. The elastic thread lines can be stretchable to stretch the puckering areas in multiple orthogonal directions toward a smooth configuration when the fabric in the puckering areas is smoothed in comparison to the puckering configuration. The stretchable sleeping bag sack can further include seams joining the fabric to form the sleeping bag sack that is configured to receive at least a torso and legs of one or more humans. The sleeping back sack can be configured to stretch in multiple orthogonal directions as one or more puckering areas are stretched from their puckering configuration toward their smooth configuration.

According to yet another aspect, a stretchable fabric system includes a series of puckering areas of a fabric that are spaced from each other in multiple directions. Elastic thread lines sewn into the fabric can extend along borders of the puckering areas. The elastic thread lines can bias the puckering areas toward a puckered configuration wherein the puckering areas are gathered together to pucker the fabric in the puckering areas. The elastic thread lines can be stretchable to stretch the puckering areas in multiple orthogonal directions toward a smooth configuration wherein the fabric in the puckering areas is smoothed in comparison to the puckered configuration. The elastic thread lines can form a pattern that can include multiple thread line segments extending substantially along the same path segment along a border of one of the puckering areas.

This Summary is provided to introduce a selection of concepts in a simplified form. The concepts are further described below in the Detailed Description. This Summary is not intended to identify key features or essential features of the claimed subject matter, nor is it intended to be used to limit the scope of the claimed subject matter. Similarly, the invention is not limited to implementations that address the particular techniques, tools, environments, disadvantages, or advantages discussed in the Background, the Detailed Description, or the attached drawings.

BRIEF DESCRIPTION OF THE DRAWINGS

The description and drawings may refer to the same or similar features in different drawings with the same reference numbers.

DETAILED DESCRIPTION

Figure 1:
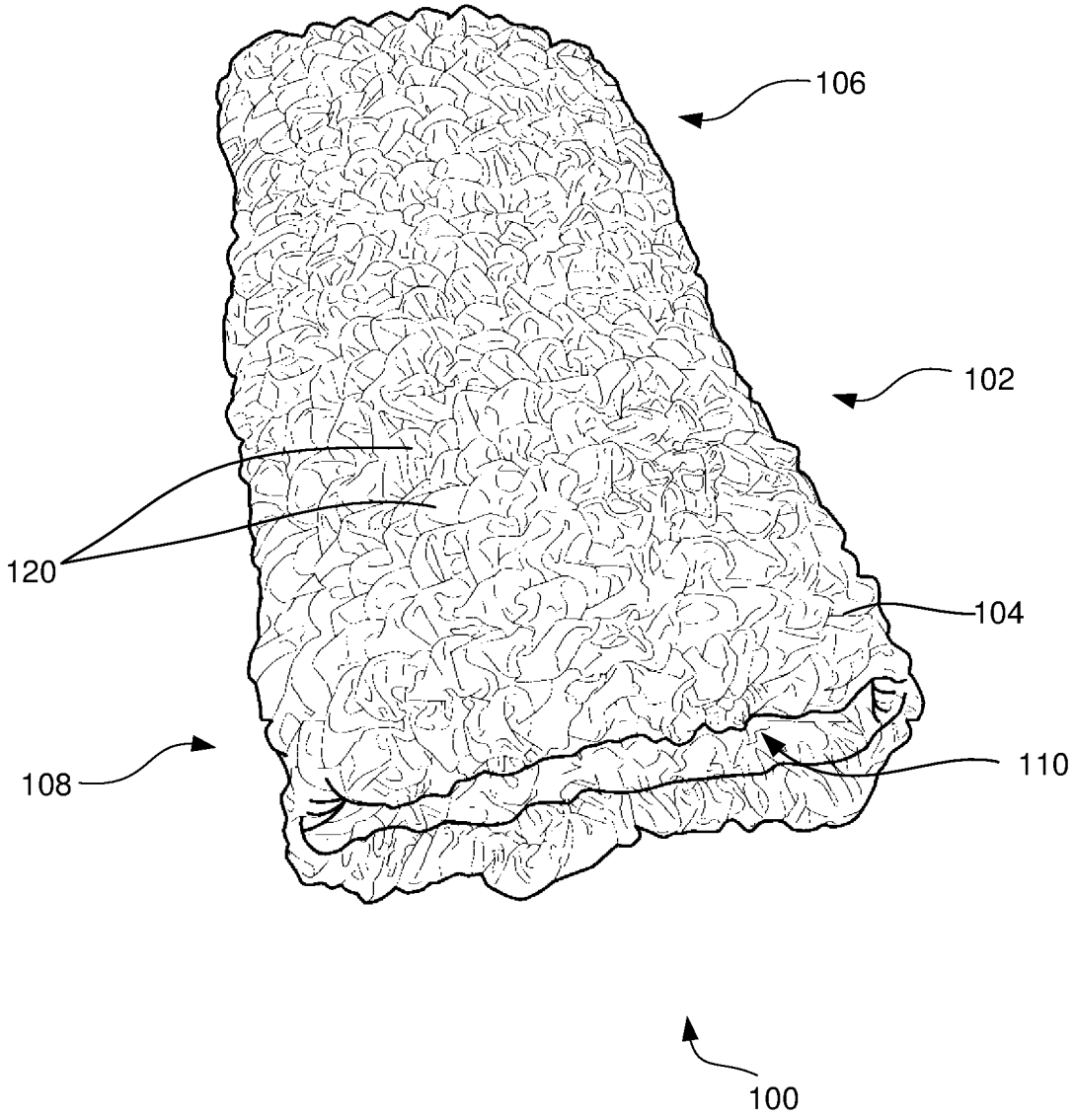
FIG. 1 is an isometric view from a head end of a sleeping bag sack formed of puckering stretchable fabric.
Figure 2:
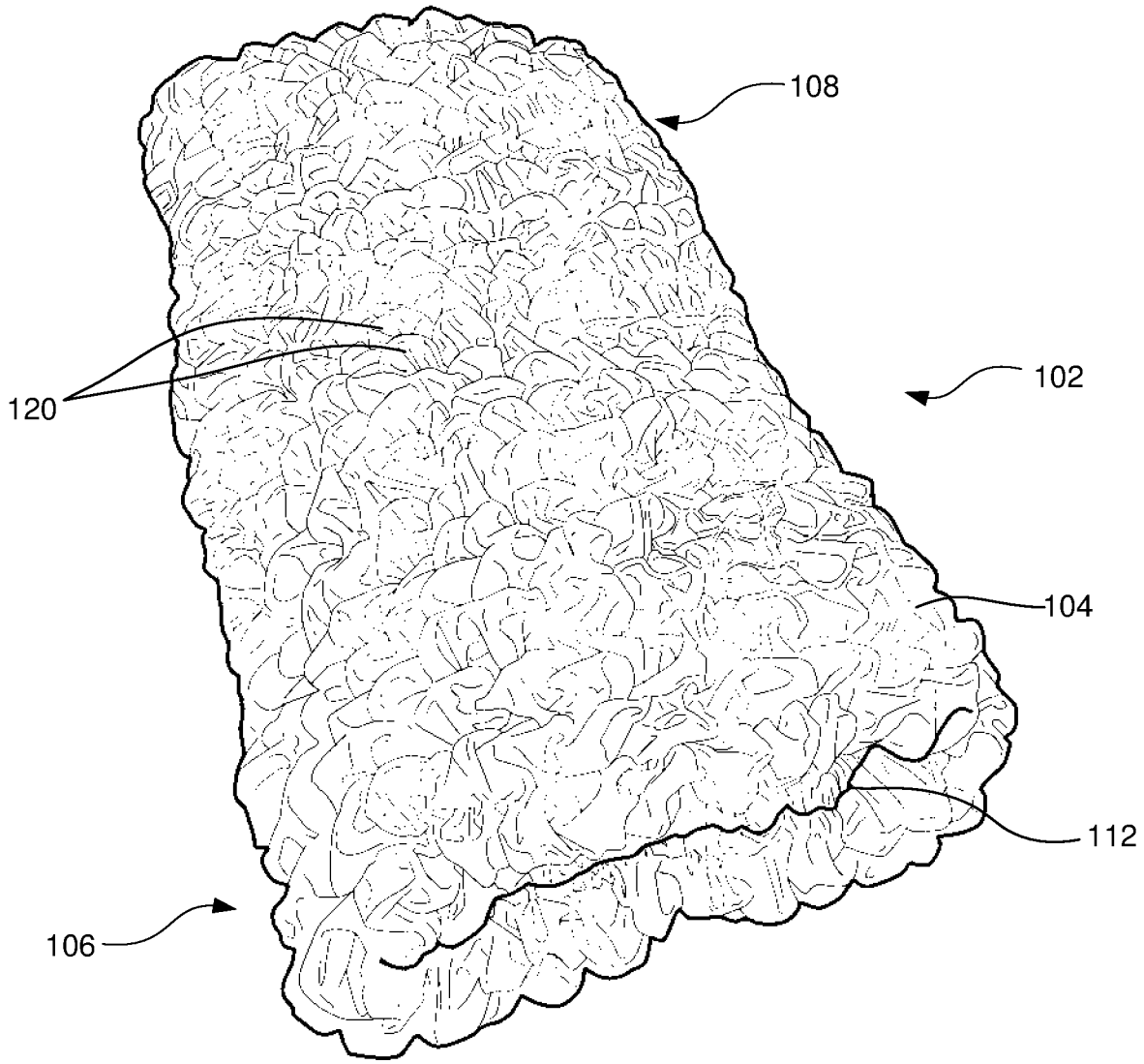
FIG. 2 is an isometric view from a foot end of the sleeping bag sack of FIG. 1.

Referring to FIGS. 1-2, a sleeping bag sack (100) is illustrated. The sleeping bag sack (100) can be made of a stretchable fabric system (102) that includes puckering fabric (104) across the entire sleeping bag sack (100). The sleeping bag sack (100) can be used as a sleeping bag, as a sleeping bag insert, or as a warming sack to cover one or more persons' legs and possibly also part of one or more persons' torso or torsos, such as while sitting. The sleeping bag sack (100) includes a foot end (106) that is closed and a head end (108) that defines an opening (110) into the body of the sleeping bag sack (100). The sleeping bag sack (100) can be formed by stitching seams (112) to join the puckering fabric (104) together, or by joining the puckering fabric (104) in other ways. For example, the sleeping bag sack (100) can include a tube of the puckering fabric (104) that is sewn together at a seam (112) to form the closed foot end (106). The tube can include a single layer of puckering fabric (104), or the tube may include multiple layers, such as an inner layer and an outer layer.

The stretchable fabric system (102) of the sleeping bag sack (100) can include a series of puckering areas (120) of the fabric (104) that are spaced apart from each other in multiple directions, with the puckering areas (120) being defined by a pattern (128) of elastic thread lines (130) (see, e.g., FIGS. 6-7) extending along the borders of the puckering areas (120). The puckering areas (120) may cover the entire sleeping bag sack (100), or the puckering areas (120) may cover some lesser portion of the sleeping bag sack, such as at least fifty percent, sixty percent, eighty percent, or ninety percent of the sleeping bag sack. As used herein an elastic thread line refers to a series of stitches along a straight or curved path that includes an elastic thread that is stretchable. The elastic thread line can include a non-elastic thread and an elastic thread that together form the stitching on an elastic thread line (130). For example, such a thread line (130) may be formed by performing a lock stitch with a sewing machine using a non-elastic thread loaded in the top portion of the sewing machine and an elastic thread loaded in the bobbin. The tension of the top thread and the elastic bobbin thread can each be adjusted to produce desired amounts of stretch for the elastic thread and desired stitching features. As another possibility, the elastic thread lines (130) may be sewn using a chain stitch machine.

The elastic thread lines (130) can bias the puckering areas (120) toward a puckered configuration wherein the puckering areas (120) are gathered together to form a puckering of the fabric (104) in the puckering areas (120). Such a puckering configuration is illustrated in the sleeping bag sack (100) of FIGS. 1-2, as well as a blanket (140) illustrated in FIG. 3. The dimensions of the sleeping bag sack (100) and the blanket (140) can be varied according to how the products (100 and 140) are to be used. Also, the stretchable fabric system (102) can be used to form other products, such as pillows and bedding, clothing and accessories, pet items, or coffin liners.

Figure 4:
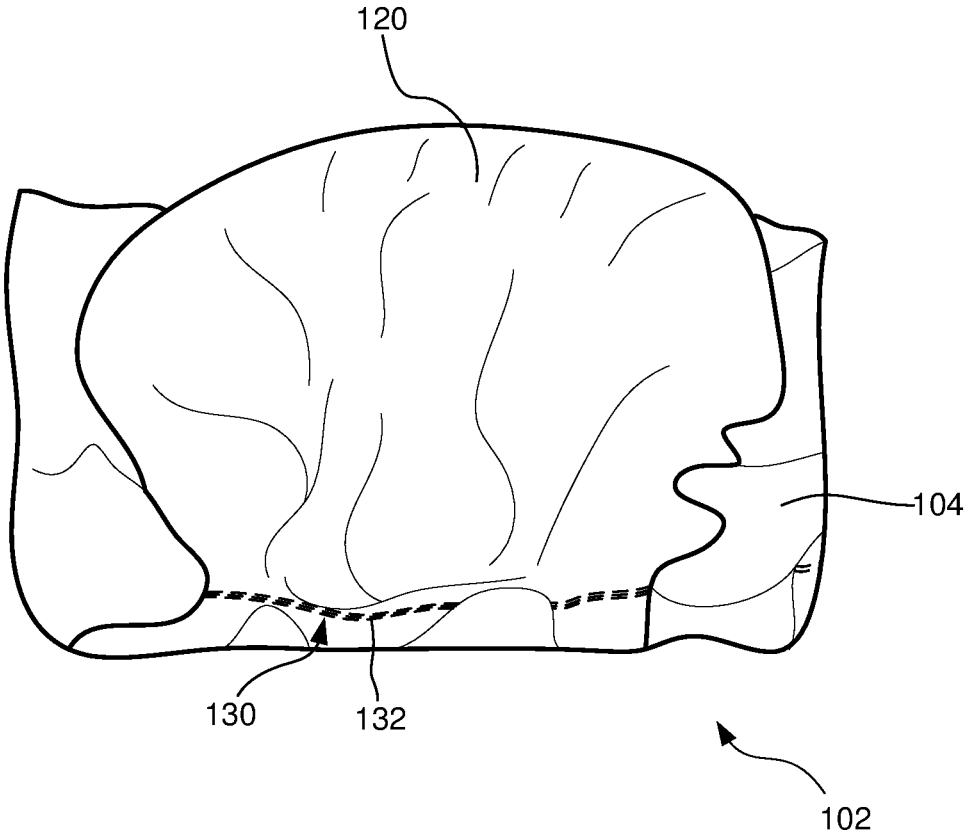
FIG. 4 is a side view of a rectangular shaped puckering area of a puckering stretchable fabric in a puckered configuration, with the fabric in the puckering area extending upward toward the top of the view.
Figure 5:
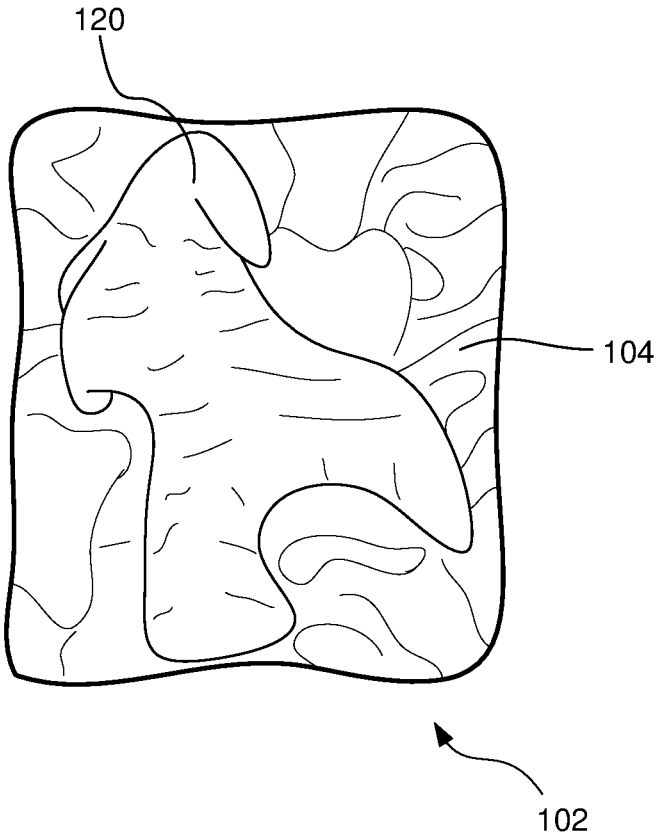
FIG. 5 is a top view of the puckering area of FIG. 4 in the puckering configuration, with the fabric in the puckering area extending toward the point of view. Note that the shape of the puckering area is not necessarily the same between FIGS. 4-6 because the shape of the puckering area can change and be many different shapes and still be puckered to include folds and gathers in multiple directions, as discussed herein.
Figure 6:
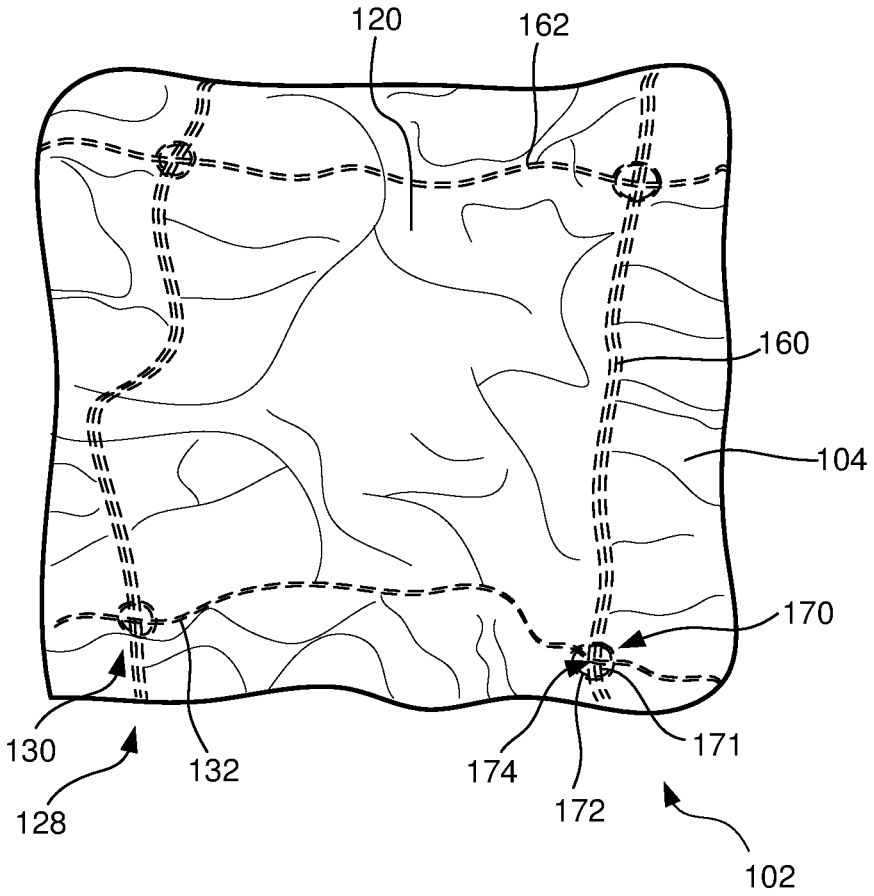
FIG. 6 is a bottom view of the puckering area of FIG. 4 in the puckering configuration, with the fabric in the puckering area extending away from the point of view.
Figure 7:
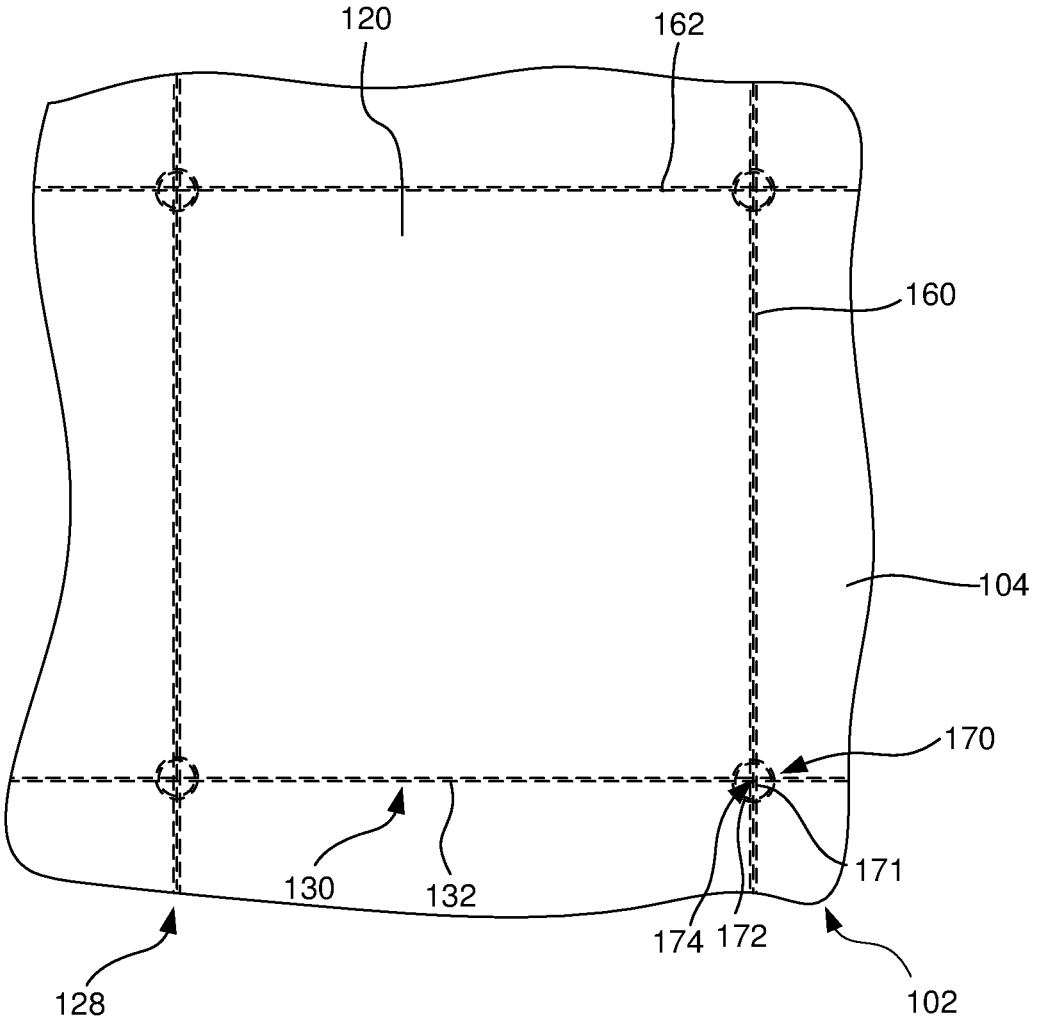
FIG. 7 is a top view of the puckering area of FIG. 4 in a smooth configuration that is stretched from the puckering configuration of FIGS. 4-6.

The puckering configuration is also illustrated in the puckering area (120) in FIGS. 4-6. FIG. 7 illustrates a smooth configuration of the puckering area (120) of FIGS. 4-6. In the smooth configuration, the fabric (104) is pulled tight in multiple directions, such as multiple orthogonal directions, to overcome the biasing force of the elastic thread lines (130). In this smooth configuration, the puckering area (120) is spread over a larger area than in the puckering configuration. Thus, when the puckering area (120) is in the puckering configuration, the puckering area can stretch in multiple different orthogonal directions. By having a grid, or two-dimensional series, of such puckering areas (120) spread over the stretchable fabric system (102), the stretchable fabric system (102) can stretch in multiple different directions by stretching one or more of the puckering areas (120) against the elastic force of the elastic thread lines (130) that extend around and define the puckering area(s) (120) being stretched.

Referring to FIGS. 4-7, an example of a puckering area (120) is discussed in additional detail. FIG. 4 is a side view of the puckering area (120), FIG. 5 is a top view of the puckering area (120), with the puckering area (120) extending up toward the point of view (so that the view is generally of a convex top surface of the puckering area (120), which is also seen in FIG. 4), and FIG. 6 is a bottom view of the puckering area (120), with the puckering area extending up away from the point of view (so that the view is of a concave bottom surface of the puckering area (120)). FIGS. 4-6 all illustrate the puckering area (120) in a puckering configuration, wherein the elastic thread lines (130) pull the puckering area (120) inwardly, so that the puckering area puckers upwardly.

FIG. 7 is a top view of the puckering area (120), like FIG. 5, but illustrating the puckering area (120) in a smooth configuration, wherein the fabric (104) is pulled in multiple directions to overcome the biasing force of the elastic thread lines (130) so that the fabric of the puckering area (120) lays flat and is smooth. As an example, in the smooth configuration of FIG. 7, a distance across the puckering area (120) can increase by about 1.5 times to about 3.5 times, or by about 2 times to about 3 times, or by about 2.25 times to about 2.75 times. For example, if the distance increased by about 2.29 times, then a distance across the puckering area (120) (e.g., between two intersections along a thread line segment) that was 1.75 inches in the puckering configuration may increase to about 4 inches. Thus, the elastic thread in the elastic thread lines (130) can be thread that can elastically stretch to at least about 1.5 times its original non-stretched length.

Referring to FIGS. 6-7, the elastic thread lines (130) around the puckering area (120) can include multiple segments (132) of the elastic thread lines (130) extending along the same thread path. In the example illustrated in FIGS. 4-7, the puckering area (120) is rectangular (which may be a square, which is a type of rectangle), being bordered by two sets of parallel thread paths that each includes multiple elastic thread line segments (132). The thread paths can be aligned with the grain of the fabric (104). Thus, the thread paths can include two lengthwise paths (160) on opposite sides of the puckering area (120) aligned with the lengthwise grain direction of the fabric (104), and two crosswise paths (162) on opposite sides of the puckering area (120) aligned with the crosswise grain direction of the fabric (104). The elastic thread lines (130) can include three thread line segments (132) extending along each lengthwise path (160) and two thread line segments (132) extending along each crosswise path (162). Such different numbers of thread line segments (132) in different directions can produce a first density of thread line segments extending substantially parallel to a first direction and a second density of thread line segments extending substantially parallel to a different second direction, with the first density being different than the second density. This can account for different stretch and strength properties of the different grain directions of the fabric to produce desired amounts of elastic bias in each direction. For example, it has been found that at least for some fabrics, the fabric gathers easier in the crosswise direction than in the lengthwise direction. Having additional thread line segments (132) in the lengthwise direction, as compared to the crosswise direction, can help the gathering of the fabric (104) in the lengthwise direction to more closely match the gathering of the fabric (104) in the crosswise direction.

Different numbers of thread line segments (132) can be used in different embodiments. For example, each thread path (160 and 162) may include the same number of thread line segments (132) regardless of the direction of the thread path (160 or 162). For example, each thread path (160 and 162) may include two thread line segments (132), or each thread path (160 and 162) may include only a single thread line segment (132) in some embodiments.

The lengthwise paths (160) can cross the crosswise paths (162) at intersections (170). At such intersections (170), the elastic thread lines (130) can include sections (171) passing through the intersections. At least some of the sections (171) can form at least partial loops (172) around central points (174) of the intersections (170). In the example illustrated in FIGS. 6-7, the thread line sections (171) can form two circular loops (172) around each intersection (170). In other embodiments, a single loop (172) or more than two loops (172) may be formed around the central point (174) of each intersection (170), so that each intersection (170) may be circumscribed by one, two, three, or more loops (172). Also, the loops (172) may be shapes other than circular shapes. For example, the loops (172) may be part or all of rectangles, triangles, ovals, polygons with more than four sides, or other shapes. The loops (172) can increase the number of thread line sections (171) that are crossed by each thread line section (171) that passes through the intersection, beyond the number of crossings that would have been present if there had been no looping of the thread line sections (171). For example, a number of thread line crossings for a thread line section (171) in an intersection (which can include that thread line section (171) crossing itself and/or crossing other thread line sections (171) passing through the intersection (170)) can be greater than a number of thread line sections entering the intersection (170) at a non-zero angle to that thread line section. For example, a thread line section (171) passing through the intersection (170) may have at least two thread line section crossings (171), at least three thread line section crossings, at least four thread line section crossings, or some other number of thread line section crossings.

By having a thread line section (171) cross more thread lines (130) at an intersection (170), that thread line section (171) can be more securely fastened at that intersection (170), as the thread line sections (171) passing through the intersection (170) are secured to each other. Such additional security in the fastening can be beneficial if a thread line (130) breaks while the stretchable fabric system (102) is in use. If an elastic thread breaks, the residual tension in the elastic thread in a thread line (130) can cause the thread line (130) to untie from the fabric (104) more readily than a regular thread line with non-elastic thread (such as cotton thread, wool thread, rayon thread, etc.). However, if a section (171) of the thread line (130) is sufficiently secure at an intersection (170) adjacent to the break in the thread, then the untying of the thread line (130) due to the break can be stopped at that intersection (170), rather than extending along the entire length of the thread line (130) (which may be across an entire product, such as a sleeping bag sack (100) or a blanket (140)).

The puckering areas (120), such as the one illustrated in FIGS. 4-7, can be repeated in multiple directions across the fabric (104) of a product, such as a blanket (140) or a sleeping bag sack (100). The puckering areas (120) may cover the entire fabric (104), or they may only be included in a portion of the fabric (104), with the fabric including some puckering regions with puckering areas (120) and other non-puckering regions without puckering areas (120). For example, a fabric (104) may include multiple strips that are puckering regions separated by strips that are non-puckering regions.

Figure 8:
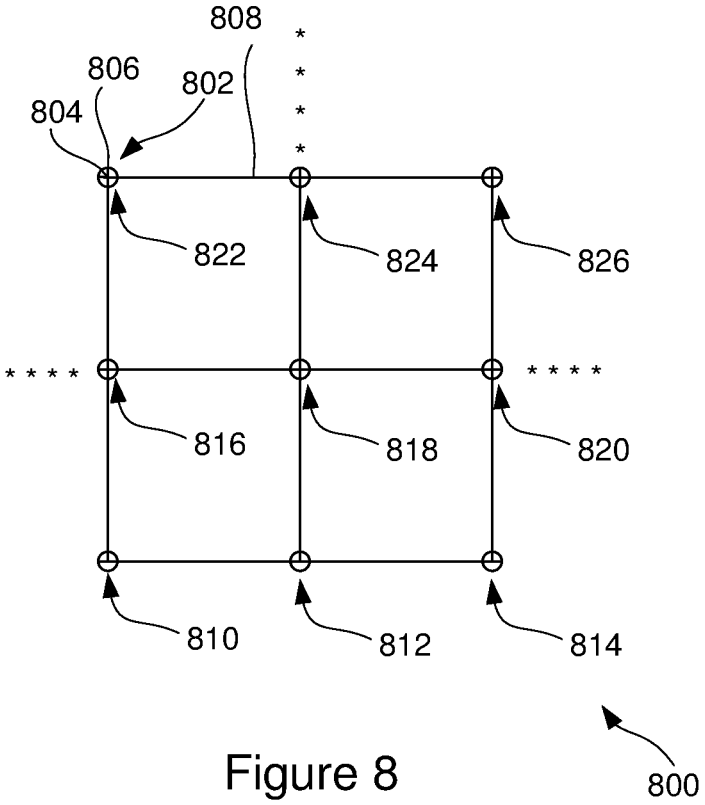
FIG. 8 is an illustration showing a first pattern of elastic thread paths extending along borders of rectangular puckering areas.

Referring now to FIG. 8, an example of a stitching pattern (800) for the stretchable fabric system (102) will be discussed. The pattern illustrated in FIG. 8 is a rectangular stitching pattern (800) (defining rectangular puckering regions bounded by thread path segments), which may be aligned along the lengthwise and crosswise directions of a fabric to be sewn. The pattern includes intersections (802) that can each include a central point (804) and can include a thread path loop (806) around the central point (804). The intersections (802) can be joined by thread path segments (808).

Figure 3:
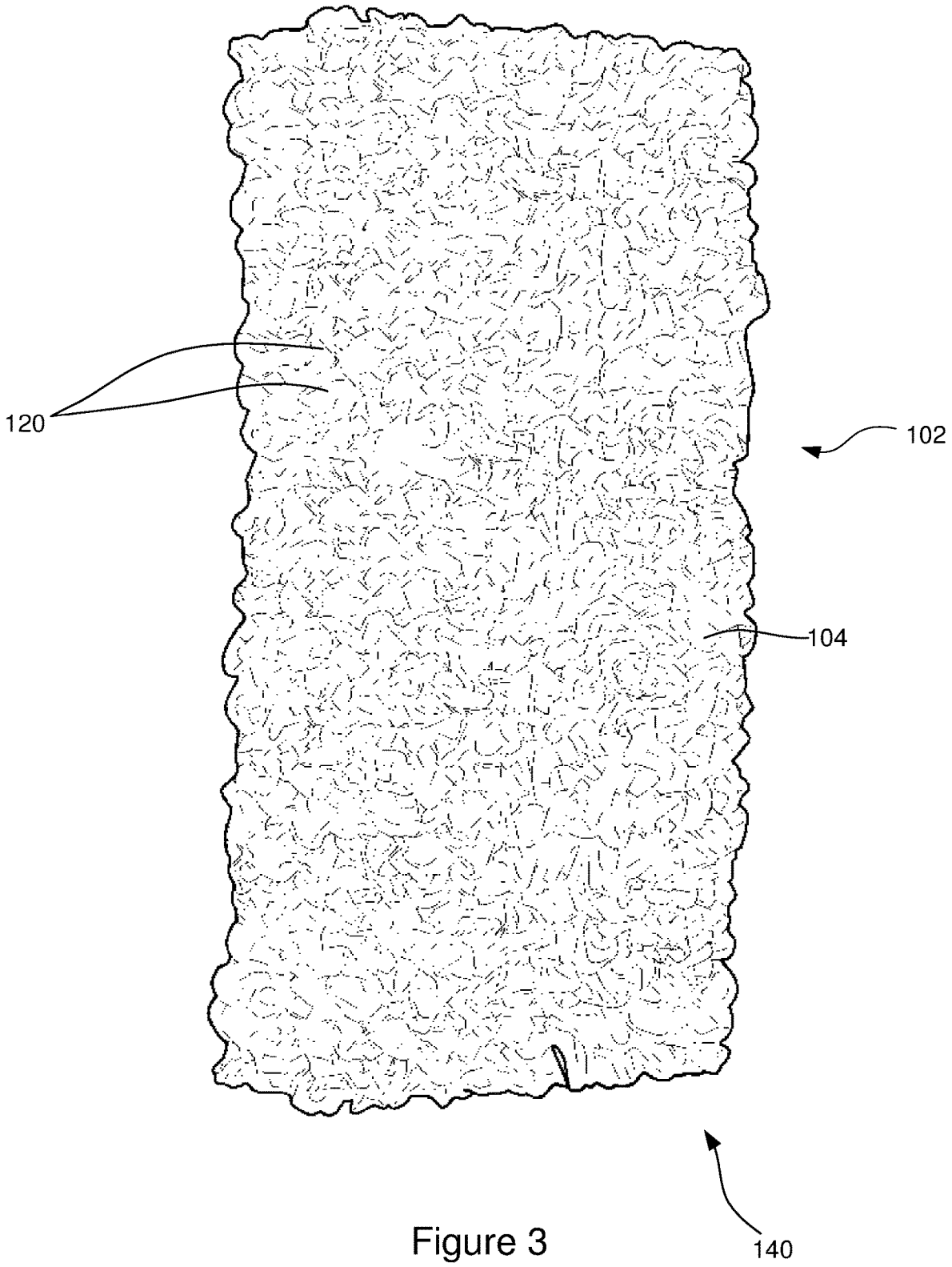
FIG. 3 is a top view of a blanket formed of puckering stretchable fabric.

The pattern (800) and the stitching sequence for the pattern (800) discussed below can continue to be repeated to the left, right, and top of the pattern (800) to form a larger pattern of stitching paths to define a large two-dimensional array of puckering areas, as in the sleeping bag sack (100) and the blanket (140) illustrated in FIGS. 1-3. The same is true of the patterns in FIGS. 9-10, discussed below. This repeating of the pattern is indicated by the asterisks (* * * *) in each of FIGS. 8-10.

For the sake clarity in the stitching descriptions below and at other places in this description, directional terms (e.g., up, down, left, right) may be used. Such directions should not be taken as limiting the overall stretchable fabric system, the fabric itself, or a sequence or pattern to be oriented in a particular orientation relative to actual horizontal or vertical directions during use or manufacturing. Also, the intersections (802) of the pattern (800) illustrated in FIG. 8 can be numbered as follows for the sake of simplicity in the description: a bottom row of intersections in FIG. 8 includes (from left to right) an intersection (810), an intersection (812), and an intersection (814); a next row up includes (from left to right) an intersection (816), an intersection (818), and an intersection (820); and a next row up includes (from left to right) an intersection (822), an intersection (824), and an intersection (826). In the discussion below, when discussing stitching multiple thread lines along the same path or portion of a path (path segment, etc.), the stitching may be substantially along that same path or portion of a path, which can allow for some deviation from the exact path as a practical matter, such as deviation due to normal tolerances in stitching with a machine and/or by hand. As used herein, thread lines are considered to be running substantially along the same path if they are forming the same part of the overall stitching pattern, such as where both thread lines extend along a border between two adjacent puckering areas. As an example, two thread lines may be considered to extend along the same path if the thread lines are within a few millimeters of each other as they extend along the path, such as within five, four, three, or two millimeters of each other.

When stitching the pattern (800), each time a stitching thread path is to loop around an intersection (802) in the pattern (800), the stitching can pass through the central point (804) of the intersection (802) and continue in the same direction to the thread path loop (806). The stitching can then make a complete loop around the thread path loop (806). The stitching can then proceed back to the central point (804) of that intersection (802) and then proceed away from the intersection (802) along a thread path segment (808) toward another intersection (802). Other looping techniques may be used so long as they result in increased numbers of crossings of thread lines at the intersections (802).

An example of a sequence for stitching an elastic thread line with the pattern (800) will now be discussed. In this example, a thread line can start at the central point (804) of the intersection (814) and stitch to the left along the path segment (808) to the intersection (812). At the intersection (812), the stitching can change direction one-hundred and eighty degrees to come back to the intersection (814) (resulting in two elastic thread lines along the thread path segment (808) between the intersection (812) and the intersection (814)). Upon arriving back at the intersection (814), the stitching can loop around the thread path loop (806) of the intersection (814). The stitching of the elastic thread line can then continue from the intersection (814) to the central point (804) of the intersection (820), back to the central point (804) of the intersection (814), and back again to the intersection (820) (resulting in three thread lines between the intersection (814) and the intersection (820)). Upon reaching the intersection (820) the second time, the stitching can loop around the thread path loop (806) of the intersection (820).

The stitching sequence that began at intersection (814) can then be repeated starting at the intersection (820). Specifically, the stitching can proceed from the central point (804) of the intersection (820) along a thread path segment (808) to the central point (804) of the intersection (818) and back along that thread path segment (808) to the central point (804) of the intersection (820). The stitching can then proceed around the thread path loop (806) of the intersection (820) (creating a second thread path loop around the intersection (820)). The stitching can then proceed from the intersection (820), to the intersection (826), back to the intersection (820), and back to the central point (804) of the intersection (826). The stitching can then loop around the thread path loop (806) of the intersection (826). The stitching sequence that was performed starting at the intersection (814) and then again starting at the intersection (820) can be performed starting at the intersection (826).

Another thread line can be sewn by performing these same stitching sequences, starting at the intersection (812), instead of the intersection (814). Specifically, this stitching can proceed from the intersection (812) to the intersection (810) and back to the intersection (812). The stitching can then loop around the thread path loop (806) of the intersection (812), and proceed to the intersection (818), back to the intersection (812), and back again to the intersection (818). The stitching can then loop around the thread path loop (806) of the intersection (818). This sequence can be repeated starting at the intersection (818), stitching to the intersection (816) and back to the intersection (818), then looping around the thread path loop (806) of the intersection (818). The stitching can continue to the intersection (824), back to the intersection (818), and back to the intersection (824), then looping around the thread path loop (806) of the intersection (824). The stitching of this elastic thread line can continue by repeating the sequence starting at the intersection (824). Additional thread lines can be sewn by performing the same stitching sequence starting at intersections to the left of the intersection (812) and to the right of the intersection (814).

In the pattern (800), the thread path segments (808) that extend vertically in the figure (e.g., from the intersection (812) to the intersection (818)) can extend along the lengthwise grain of the fabric, with three elastic thread lines extending along each such thread path segment (808). The thread path segments that extend horizontally in the figure (e.g., from the intersection (812) to the intersection (814)) can extend along the crosswise grain of the fabric, with two elastic thread lines extending along each such thread path segment (808).

The stitching of the elastic thread lines starting at different intersections (such as the thread line started at intersection (812) and the thread line started at intersection (814)) can be stitched in series one after the other, or they may be sewn at the same time, such as with a multi-needle embroidery machine.

Figure 9:
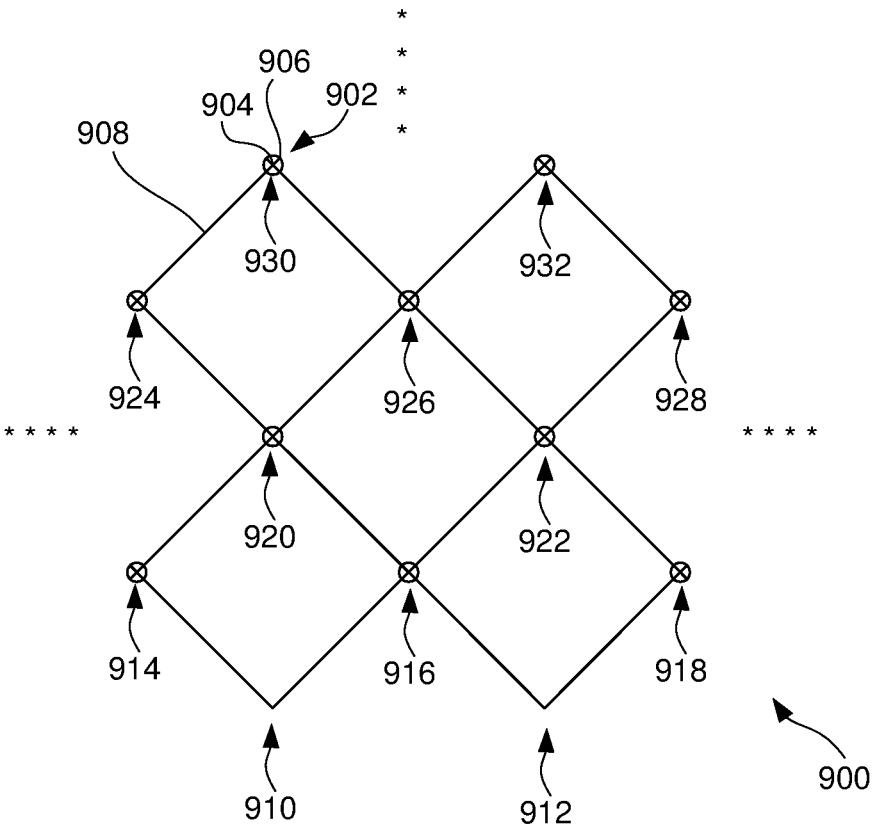
FIG. 9 is an illustration showing a second pattern of elastic thread paths extending along borders of rectangular puckering areas.

Referring now to FIG. 9, another example of a stitching pattern (900) for the stretchable fabric system (102) will be discussed. The pattern illustrated in FIG. 9 is a diamond-shaped stitching pattern (900), which can yield square puckering areas with elastic thread lines that can be aligned at forty-five-degree angles to the fabric grain directions (i.e., in the bias directions). As with the pattern (800) of FIG. 8, the pattern (900) can include intersections (902) that can each include a central point (904) and can include a thread path loop (906) around the central point (904). The intersections can be joined by thread path segments (908).

The intersections (902) of the pattern (900) can be numbered as follows to assist in the description of stitching sequences below: a bottom row of intersections in FIG. 9 includes (from left to right) an intersection (910) and an intersection (912); a second row up (next up from the bottom) includes (from left to right) an intersection (914), an intersection (916), and an intersection (918); a third row up includes (from left to right) an intersection (920) and an intersection (922); a fourth row up includes (from left to right) an intersection (924), an intersection (926), and an intersection (928); and a fifth row up includes (from left to right) an intersection (930) and an intersection (932). Each row of intersections can be offset from the row below and above it, so that the thread path segments between the intersections of adjacent rows extend at forty-five-degree angles from vertical in FIG. 9 (and at angles of forty-five degrees from the grain directions of the fabric being stitched).

As with the pattern (800), when stitching the pattern (900), each time a stitching thread path is to loop around an intersection (902) in the pattern (900), the stitching can pass through the central point (904) of the intersection (902) and continue in the same direction to the thread path loop (906). The stitching can then make a complete loop around the thread path loop (906). The stitching can then proceed back to the central point (904) of that intersection (902) and then proceed away from the intersection (902) along a thread path segment (908) toward another intersection (902). Other looping techniques may be used so long as they result in increased numbers of crossings of thread lines at the intersections (902).

An example of a sequence for stitching an elastic thread line with the pattern (900) will now be discussed. In this example, a thread line can start at the central point (904) of the intersection (912) and stitch upwardly and to the right along a thread path segment (908) to the intersection (918). The stitching can loop around the thread path loop (906) of the intersection (918) and proceed upwardly and to the left along a thread path segment (908) to the intersection (922). The stitching can loop around the thread path loop (906) of the intersection (922). The stitching can then proceed downwardly and to the left along a thread path segment (908) to the intersection (916), and downwardly to the right along a thread path segment (908) back to the intersection (912). This can be done without looping around the intersection (916) or the intersection (912). Alternatively, this may include looping at least around the intersection (912) for the bottom-most stitching sequence so that the intersection (912) can include looping thread lines around the intersection (912). This sequence can then be repeated, including stitching to the intersection (918), looping around the intersection (918), stitching to the intersection (922), looping around the intersection (922), stitching to the intersection (916), and stitching to the intersection (912). The sequence can then include stitching to the intersection (918), looping around the intersection (918), stitching to the intersection (922), and looping around the intersection (922).

The sequence in the preceding paragraph can be repeated starting at the intersection (922) instead of the intersection (912). Specifically, this can include stitching to the intersection (928), looping around the thread path loop (906) of the intersection (928), stitching to the intersection (932), looping around the thread path loop (906) of the intersection (932), stitching to the intersection (926), and stitching back to the intersection (922). This sequence can then be repeated by stitching to the intersection (928), looping around the thread path loop (906) of the intersection (928), stitching to the intersection (932), looping around the thread path loop (906) of the intersection (932), stitching to the intersection (926), and stitching back to the intersection (922). The sequence can then include stitching to the intersection (928), looping around the thread path loop (906) of the intersection (928), stitching to the intersection (932), and looping around the thread path loop (906) of the intersection (932). This sequence can be continued with intersection above those shown in FIG. 9.

Also, other elastic thread lines can be stitched with the same sequence on both sides of the thread line resulting from the stitching discussed above. For example, this can include stitching around the intersections (910, 916, 920, and 914) to the left in the same manner as the stitching around the intersections (912, 918, 922, and 916) discussed above. Likewise, this same elastic thread line can continue to stitch around the intersections (920, 926, 930, and 924) in the same manner as the stitching around the intersections (922, 928, 932, and 926) discussed above. And again, this stitching can continue through intersections that are above the one shown in FIG. 9. Also, this stitching can include stitching additional thread lines with the same stitching sequence, but to the left and right of the thread lines discussed above.

Figure 10:
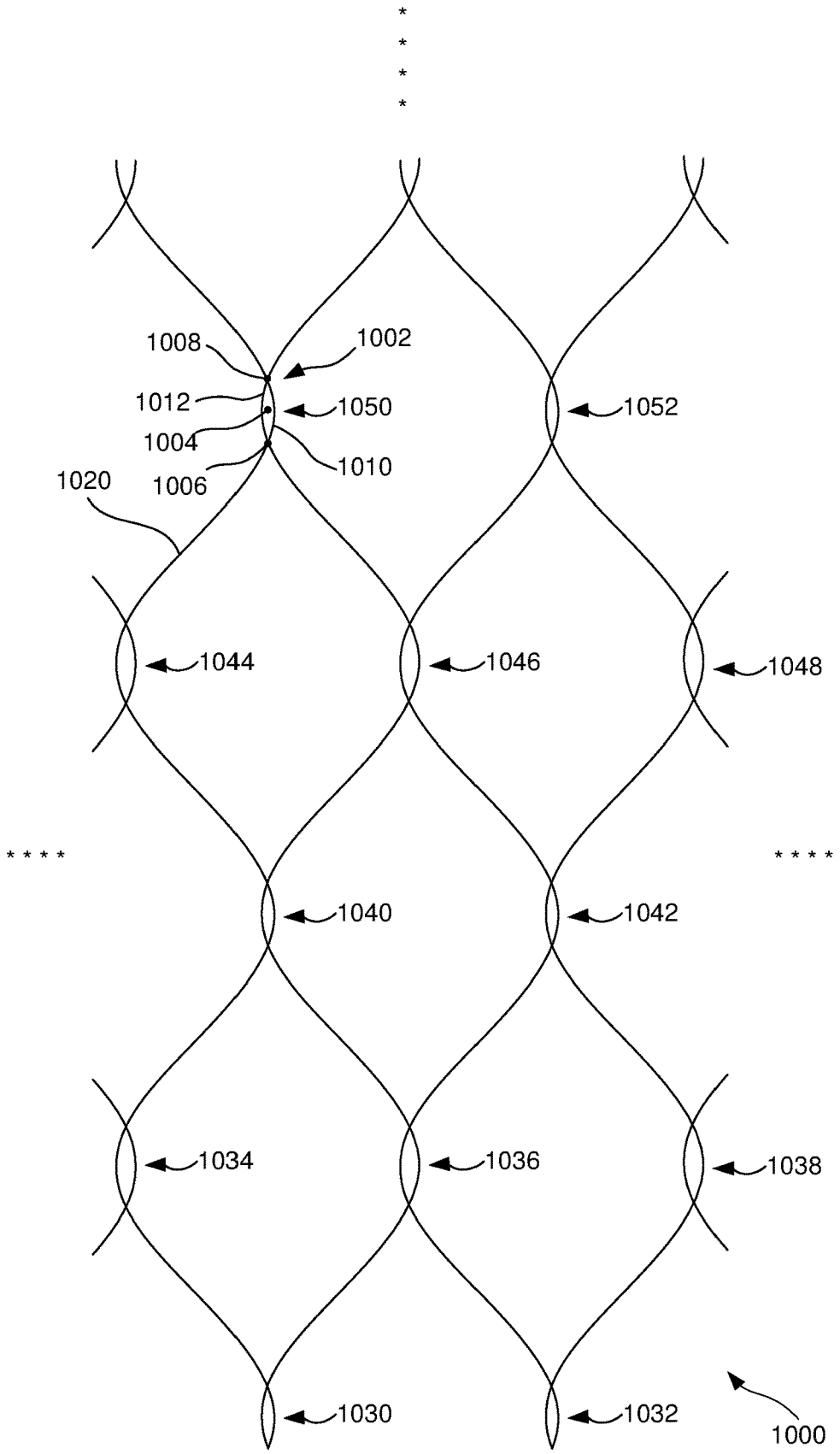
FIG. 10 is an illustration showing a pattern of curved thread paths extending along borders of curved puckering areas.

Referring now to FIG. 10, an example of a curved stitching pattern (1000) and an example of a sequence for stitching along the curved stitching pattern (1000) for the elastic thread lines of the stretchable fabric system (102) will be discussed. The pattern illustrated in FIG. 10 is a curved pattern with wave-shaped thread paths (such as sinusoidal-type curves or other similar types of curves) that curve to the left and then back to the right as they extend upwardly. The pattern (1000) includes intersections (1002) that can each include a central point (1004), a bottom point (1006) below the central point (1004), a top point (1008) above the central point (1004), a right side loop path (1010) that loops in a curved path around to the right of the central point (1004) between the bottom point (1006) and the top point (1008), and a left side loop path (1012) that loops in a curved path around to the left of the central point (1004) between the bottom point (1006) and the top point (1008). The pattern (1000) can also include path segments (1020) that extend in curved paths between the intersections (1002) as shown in FIG. 10.

The intersections (1002) of the pattern (1000) can be numbered as follows for the sake of simplicity in the description: a bottom row of intersections in FIG. 10 includes (from left to right) an intersection (1030) and an intersection (1032); a second row up includes (from left to right) an intersection (1034), an intersection (1036), and an intersection (1038); a third row up includes (from left to right) an intersection (1040) and an intersection (1042); a fourth row up includes (from left to right) an intersection (1044), an intersection (1046), and an intersection (1048); and a fifth row up includes (from left to right) an intersection (1050) and an intersection (1052).

An example of a sequence for stitching an elastic thread line with the pattern (1000) will now be discussed. In this example, the stitching of a thread line can start at the top point (1008) of the intersection (1032). The stitching can proceed along a thread path (1020) to the bottom point (1006) of the intersection (1036). The stitching can then loop around the intersection (1036) by proceeding along the left side loop path (1012) of the intersection (1036) to the top point (1008) of the intersection (1036). The stitching can then proceed along a thread path (1020) to the bottom point (1006) of the intersection (1042). The stitching can then loop around the intersection (1042) by stitching up along the right-side loop path (1010) to the top point (1008) and then back down along the left side loop path (1012) to the bottom point (1006). The stitching can continue from the bottom point (1006) of the intersection (1042) to the top point (1008) of the intersection (1038), and loop around the right-side loop path (1010) of the intersection (1038) to the bottom point (1006) of the intersection (1038). The stitching can then proceed along the thread segment (1020) from the bottom point (1006) of the intersection (1038) to the top point (1008) of the intersection (1032). The stitching can loop around the intersection (1032) by stitching down along the left side loop path (1012) of the intersection (1032) to the bottom point (1006) of the intersection (1032), and back up along the right-side loop path (1010) of the intersection (1032) to the top point (1006) of the intersection (1032). The above stitching sequence can then be repeated, including stitching to and around the intersection (1036), to and around the intersection (1042), to and around the intersection (1038), and to and around the intersection (1032), as described above. The stitching can then proceed from the top point (1008) of the intersection (1032) to the bottom point (1006) of the intersection (1036), up around the left side loop path (1012) of the intersection (1036) to the top point (1008) of the intersection (1036), along a path segment (1020) to the bottom point (1006) of the intersection (1042), and up along the right side loop path (1010) of the intersection (1042) to the top point (1008) of the intersection (1042).

The stitching can proceed from the top point (1008) of the intersection (1042) to do the same stitching sequence described in the previous paragraph, except stitching to and around intersections in the upper intersections (1046, 1052, 1048, and 1042) instead of the lower intersections (1036, 1042, 1038, and 1032).

Additionally, the stitching sequence of the preceding two paragraphs can be performed with a different elastic thread line for the left side intersections (1034, 1040, 1036, 1030, 1044, 1050, and 1046), the same way as for the right-side intersections (1036, 1042, 1038, 1032, 1046, 1052, and 1048). Additional thread lines can be sewn in the same manner to the right and left of the intersections shown in FIG. 10. This will result in the thread lines crossing themselves at some intersections (such as intersections 1030, 1032, 1040, 1042, 1050, and 1052), and crossing adjacent thread lines at intersections that are shared by multiple thread lines (such as intersections 1034, 1036, 1038, 1044, 1046, and 1048).

As has been discussed, the features of the puckering stretchable fabric system (102) can produce substantial benefits that are not present in or predictable from prior fabric systems. For example, using any of the examples patterns and stitching sequences discussed above can result in each elastic thread line crossing over multiple other thread lines at the intersections (with the possible exceptions of the bottom intersections (910 and 912) of FIG. 9, which could be left as-is with not all thread lines going into all intersections crossing multiple thread lines, or additional stitching could be included to cross with the thread lines going into the bottom intersections (910 and 912) of FIG. 9). This enhanced crossing of thread lines at the intersections can help to secure the thread lines at these intersections. Thus, if a thread line breaks, the pulling out of the thread along large sections of the stretchable fabric system (102) can be inhibited by the increased number of thread line crossings at the intersections.

As another example of the benefits, the use of multiple thread lines along the same paths can provide greater durability and greater pull (producing a greater puckering of the fabric), compared to using only a single thread line along each path. As an example of the greater durability or security, if one of the thread lines along a path were to break, then one or more other thread lines along that same path could continue providing the elastic pull along that path to keep adjacent puckering areas in their puckered configuration. Additionally, using different numbers of thread lines in different directions (such as more in the lengthwise grain direction than in the crosswise grain direction) can produce a puckering effect of the puckering areas that is similar in the different directions (such as with greater numbers of thread lines in one directions overcoming a resistance of the fabric to gathering in that direction).

Additionally, the use of the stretchable fabric system (102) for a sleeping bag sack (100) can improve comfort and insulation. This is especially true with the ability of the puckering areas to stretch to a large extent in multiple directions, while using fabric types that do not exhibit such stretch properties by themselves, though highly stretchable fabric types may also be used. Moreover, the array of puckering areas (120) in any of multiple different products can create the same aesthetically pleasing and creative appearance, which would be appropriate and aesthetically pleasing even if it existed separately in a non-useful medium as a pictorial, graphic, or sculptural work of art (e.g., as a three-dimensional sculpture or a two-dimensional picture or graphic work).

The subject matter defined in the appended claims is not necessarily limited to the benefits described herein. A particular implementation of the invention may provide all, some, or none of the benefits described herein. Although operations for the various techniques are described herein in a particular, sequential order for the sake of presentation, it should be understood that this manner of description encompasses rearrangements in the order of operations, unless a particular ordering is required. For example, operations described sequentially may in some cases be rearranged or performed concurrently. Techniques described herein with reference to flowcharts may be used with one or more of the systems described herein and/or with one or more other systems. Moreover, for the sake of simplicity, flowcharts may not show the various ways in which particular techniques can be used in conjunction with other techniques.

Some techniques involving a puckering stretchable fabric system are discussed below.

In one example, a technique can include sewing one or more elastic thread lines into a fabric while maintaining areas of the fabric being sewn in a smooth configuration. The one or more thread lines can extend along borders of puckering areas of the fabric. The elastic thread line(s) can form a pattern that includes sections of the elastic thread line(s) passing through intersections with each other. Segments of the elastic thread lines can extend between the intersections. At one or more of the intersections, the elastic thread line section(s) passing through the intersection can loop around a central point of the intersection to form at least a partial loop around the central point. The pattern can produce a greater number of thread line section crossings at the intersection than would have been present if the sections had not looped around the central point. The elastic thread lines can bias the puckering areas in multiple different non-parallel directions toward a puckering configuration. In the puckering configuration, the puckering areas can be gathered together to form a puckering of the fabric in those areas.

The technique may include stretching the fabric in multiple different non-parallel directions, with the stretching in each of the multiple directions comprising stretching at least a portion of the elastic thread lines.

The technique may include shaping and fastening the fabric together, such as sewing the fabric along one or more seams, to form a sleeping bag sack that is configured to receive at least a portion of one or more human bodies, such as at least the legs or at least the legs and torso of one or more human bodies. Alternatively, the technique may include shaping and/or fastening the fabric together, such as sewing the fabric along one or more seams, to form some other product, such as a blanket or pillow, using the stretchable fabric system.

The techniques may include a technique for using a sleeping bag sack such as the sleeping bag sack (100) discussed above. The technique may further include inserting at least a portion of at least one human body in the sleeping bag sack (100) (such as the legs, or the legs and at least part of the torso of at least one human body) and moving the human body or bodies within the sleeping bag sack (100) to stretch the sleeping bag sack (100) in multiple directions (such as multiple orthogonal directions). This can result in stretching the puckering areas (120) toward the smooth configuration using the human body or bodies in the sleeping bag sack (100).

Techniques may also include using other products such as the blanket (140), which can include covering at least part of one or more human bodies with the product such as the blanket. The technique may also include stretching the puckering areas (120) in multiple different directions as discussed in the preceding paragraph while the product such as the blanket (140) is covering at least a part of one or more human bodies that is/are moving to stretch the puckering areas (120) of the blanket in multiple different directions.

While the invention has been particularly shown and described with reference to preferred embodiments thereof, it will be understood by those skilled in the art that various changes in form and details may be made therein without departing from the spirit and scope of the invention.

We claim:

1. A method comprising:

sewing one or more elastic thread lines into a fabric while maintaining areas of the fabric being sewn in a smooth configuration, with the one or more elastic thread lines extending along borders of puckering areas of the fabric, wherein the one or more elastic thread lines form a pattern comprising elastic thread line sections of the one or more elastic thread lines passing through intersections with each other and segments of the elastic thread lines extending between the intersections, wherein at one or more of the intersections, one or more looping sections of the elastic thread line sections passing through the intersection loops around a central point of the intersection to form at least a partial loop around the central point of the intersection, wherein the pattern produces a greater number of elastic thread line section crossings at the intersection than would have been present if the one or more looping sections had not looped around the central point; and the elastic thread lines biasing the puckering areas in multiple different non-parallel directions toward a puckered configuration wherein the puckering areas are gathered together to pucker the fabric in the puckering areas.

2. The method of claim 1, further comprising stretching the fabric in the multiple different non-parallel directions, with the stretching in each of the multiple directions comprising stretching at least a portion of the elastic thread lines.

3. The method of claim 1, further comprising sewing the fabric along one or more seams to form a sleeping bag sack that is configured to receive at least a portion of one or more human bodies.

4. The method of claim 3, further comprising inserting at least a portion of one or more human bodies in the sleeping bag sack and using the one or more human bodies to stretch the sleeping bag sack in the multiple directions.

5. The method of claim 3, wherein the puckering areas cover at least fifty percent of the sleeping bag sack.

6. The method of claim 3, wherein the puckering areas cover at least ninety percent of the sleeping bag sack.

7. A stretchable fabric system comprising:

a series of puckering areas of a fabric that are spaced from each other in multiple directions; and elastic thread lines sewn into the fabric and extending along borders of the puckering areas, with the elastic thread lines biasing the puckering areas toward a puckered configuration wherein the puckering areas are gathered together to pucker the fabric in the puckering areas, and with the elastic thread lines being stretchable to stretch the puckering areas in multiple orthogonal directions toward a smooth configuration wherein the fabric in the puckering areas is smoothed in comparison to the puckered configuration; and wherein the elastic thread lines form a pattern comprising sections of the elastic thread lines passing through intersections with each other, wherein at one or more of the intersections, an elastic thread line section passing through the intersection crosses one or more elastic thread line sections to form elastic thread line section crossings in an area of the intersection, with a number of the elastic thread line section crossings for the elastic thread line section passing through the intersection being at least two.

8. The stretchable fabric system of claim 7, wherein the number of the elastic thread line section crossings is at least three.

9. The stretchable fabric system of claim 7, wherein the number of the elastic thread line section crossings for the elastic thread line passing through the intersection is greater than a number of elastic thread line sections entering the intersection at a non-zero angle to the elastic thread line section passing through the intersection.

10. The stretchable fabric system of claim 7, wherein one or more looping sections of the elastic thread line sections passing through the intersection loops around a central point of the intersection to form at least a partial loop around the central point of the intersection.

11. The stretchable fabric system of claim 10, wherein at least one of the one or more looping sections intersects at least one elastic thread line section that would not have been intersected by the at least one of the one or more looping sections passing through the central point without looping around the central point.

12. The stretchable fabric system of claim 7, wherein the pattern includes multiple elastic thread line segments extending substantially along a path segment between a pair of thread line intersections.

13. The stretchable fabric system of claim 7, wherein the pattern includes a first density of elastic thread line segments extending substantially parallel to a first direction and a second density of elastic thread line segments extending substantially parallel to a different second direction, with the first density being greater than the second density.

14. The stretchable fabric system of claim 13, wherein the pattern includes a plurality of thread line intersections that each includes a first number of elastic thread line sections entering the intersection in one or more directions parallel to the first direction and a second number of elastic thread line sections entering the intersection in one or more directions parallel to the second direction, with the first number of elastic thread line sections being greater than the second number of elastic thread line sections.

15. The stretchable fabric system of claim 13, wherein the fabric exhibits less stretch in the first direction than in the second direction prior to being sewn with the elastic thread lines.

16. The stretchable fabric system of claim 13, wherein the first direction is a lengthwise grain direction of the fabric.

17. The stretchable fabric system of claim 7, wherein the fabric is fastened together to form a sleeping bag sack that is configured to receive at least legs of one or more human bodies.

18. The stretchable fabric system of claim 17, wherein the puckering areas cover at least fifty percent of the sleeping bag sack.

19. The stretchable fabric system of claim 17, wherein the puckering areas cover at least ninety percent of the sleeping bag sack.

20. A stretchable fabric system comprising:

a series of puckering areas of a fabric that are spaced from each other in multiple directions; and elastic thread lines sewn into the fabric and extending along borders of the puckering areas, with the elastic thread lines biasing the puckering areas toward a puckered configuration wherein the puckering areas are gathered together to pucker the fabric in the puckering areas, and with the elastic thread lines being stretchable to stretch the puckering areas in multiple orthogonal directions toward a smooth configuration wherein the fabric in the puckering areas is smoothed in comparison to the puckered configuration;

wherein the elastic thread lines form a pattern comprising multiple elastic thread line segments extending substantially along a path segment along a border of one of the puckering areas; and wherein the pattern includes a first density of elastic thread line segments extending substantially parallel to a first direction and a second density of elastic thread line segments extending substantially parallel to a different second direction, with the first density being greater than the second density.

21. The stretchable fabric system of claim 20, wherein the pattern includes a plurality of thread line intersections that each includes a first number of elastic thread line sections entering the intersection in one or more directions parallel to the first direction and a second number of elastic thread line sections entering the intersection in one or more directions parallel to the second direction, with the first number of elastic thread line sections being greater than the second number of elastic thread line sections.

22. The stretchable fabric system of claim 20, wherein the fabric exhibits less stretch in the first direction than in the second direction prior to being sewn with the elastic thread lines.

23. The stretchable fabric system of claim 20, wherein the first direction is a lengthwise grain direction of the fabric.

24. The stretchable fabric system of claim 20, wherein the fabric is fastened together to form a sleeping bag sack that is configured to receive at least legs of one or more human bodies.

25. The stretchable fabric system of claim 24, wherein the puckering areas cover at least fifty percent of the sleeping bag sack.

26. The stretchable fabric system of claim 24, wherein the puckering areas cover at least ninety percent of the sleeping bag sack.

27. The stretchable fabric system of claim 20, wherein the pattern comprises elastic thread line sections of the elastic thread lines passing through intersections with each other and segments of the elastic thread lines extending between the intersections, wherein at one or more of the intersections, one or more looping sections of the elastic thread line sections passing through the intersection loops around a central point of the intersection to form at least a partial loop around the central point of the intersection, wherein the pattern produces a greater number of elastic thread line section crossings at the intersection than would have been present if the one or more looping sections had not looped around the central point.

* * * * *